US010975642B2

(12) United States Patent
Angman et al.

(10) Patent No.: US 10,975,642 B2
(45) Date of Patent: Apr. 13, 2021

(54) SHIFTING TOOL FOR A DOWNHOLE TOOL

(71) Applicant: KOBOLD CORPORATION, Calgary (CA)

(72) Inventors: Per Angman, Calgary (CA); Mark Andreychuk, Calgary (CA)

(73) Assignee: KOBOLD CORPORATION, Calgary (CA)

( * ) Notice: Subject to any disclaimer, the term of this patent is extended or adjusted under 35 U.S.C. 154(b) by 96 days.

(21) Appl. No.: 16/162,740

(22) Filed: Oct. 17, 2018

(65) Prior Publication Data

US 2019/0226293 A1 Jul. 25, 2019

Related U.S. Application Data

(60) Provisional application No. 62/619,707, filed on Jan. 19, 2018.

(51) Int. Cl.

| | |
|---|---|
| ***E21B 23/00*** | (2006.01) |
| ***E21B 33/12*** | (2006.01) |
| ***E21B 34/12*** | (2006.01) |
| ***E21B 34/14*** | (2006.01) |

(52) U.S. Cl.

CPC ..... *E21B 23/006* (2013.01); *E21B 33/12* (2013.01); *E21B 34/12* (2013.01); *E21B 34/14* (2013.01); *E21B 2200/06* (2020.05)

(58) Field of Classification Search

CPC ..... E21B 23/006; E21B 33/12; E21B 34/12; E21B 34/14; E21B 2034/007

USPC ..... 166/334.1

See application file for complete search history.

(56) References Cited

U.S. PATENT DOCUMENTS 4,270,608 A * 6/1981 Hendrickson ..... E21B 43/045 166/278

* cited by examiner

*Primary Examiner* — Matthew R Buck
*Assistant Examiner* — Patrick F Lambe
(74) *Attorney, Agent, or Firm* — Parlee McLaws LLP; Chi Fai Andrew Lau

(57) ABSTRACT

A shifting tool is provided for locating and actuating downhole tools in a downhole tubular string, such as sleeve valves spaced along a completion string. The shifting tool includes dogs at ends of two or more radially controllable, and circumferentially spaced support arms. The arms are manipulated with an axially movable arm-constrictor spider for engaging radially variable cams on the sides of the arms. The spider includes cam follower tabs to cam the arms radially inward for in and out of hole movement, and for releasing the arms for sleeve locating and sleeve profile engagement. The tabs are radially inset from the arms to minimize obstruction of a tool annulus and interference damage when travelling along the downhole string.

19 Claims, 6 Drawing Sheets

SHIFTING TOOL FOR A DOWNHOLE TOOL

CROSS-REFERENCE TO RELATED APPLICATIONS

This application claims the benefit of U.S. Provisional Patent application Ser. No. 62/619,707, filed Jan. 19, 2018, the entirety of which is incorporated herein by reference.

FIELD

Embodiments herein relate to apparatus for completion of a wellbore, particularly to a shifting tool for shifting an element in a downhole tool such as a sleeve and more particularly to an arrangement to radially actuate a dog to engage a dog-receiving profile of the downhole tool.

BACKGROUND

It is well known to line wellbores with a completion string, liners or casing and the like and, thereafter, to create flowpaths through the casing to permit fluids, such as fracturing fluids, to reach the formation therebeyond. One such conventional method for creating flowpaths is to perforate the casing using apparatus such as a perforating gun, which typically utilize an explosive charge to create localized openings through the casing. Alternatively, the casing can include pre-machined ports, located at intervals therealong. The ports are typically sealed during insertion of the casing into the wellbore, such as by a dissolvable plug, a burst port assembly, a sleeve or the like. Optionally, the casing can thereafter be cemented into the wellbore, the cement being placed in an annulus between the wellbore and the casing. Thereafter, the ports are typically selectively opened by removing the sealing means to permit fluids, such as fracturing fluids, to reach the formation.

Typically, when sleeves are used to seal the ports, the sleeves are releasably retained over the ports, also known as sleeve valves, and can be actuated to slide within the casing to open and close the respective ports. Many different types of sleeves and apparatus to actuate the sleeves are known in the industry. Fluids are directed into the formation through the open ports. At least one sealing means, such as a packer, is employed to isolate the balance of the wellbore below the sleeve from the treatment fluids.

A variety of tools are known for actuating sleeves in ported subs including the use of shifting tools, profiled tools and packers. In U.S. Pat. No. 6,024,173 to Patel and assigned to Schlumberger, a shifting tool and a position locator is disclosed for locating a downhole device and engaging a packer element within moveable member and operating the device using and applied axial force to shift the member.

In Canadian Patents 2,738,907 and 2,693,676, both to NCS Oilfield Services Canada Inc., a bottom hole assembly (BHA) is deployed at an end of coiled tubing and located adjacent a ported sub by a sleeve locator. The BHA has a sealing member and also includes an anchor in a tool similar to a releasable bridge plug or well packer, which are set inside the ported sub fit for shifting a sliding sleeve and opening ports to the wellbore. The sealing member, the releasable anchor and incorporation of a sleeve locator, all of which must be cooperatively locatable within the sleeve housing, requires a sleeve housing of significant length and related expense. Further, without additional components, the releasable anchoring system is generally limited to downhole actuation of the sleeve.

In Applicant's pending application published as US20170058644A1 on Mar. 2, 2017, the entirety of which is included herein by reference, a shifting tool was disclosed using keys or dogs for engaging profile in sleeves. Dogs at ends of radially controllable, and circumferentially spaced support arms are actuated radially inward to overcome biasing for either into and out-of-hole movement, and for releasing the arms for sleeve locating and sleeve profile engagement. The dogs can be positively lock in the sleeve profile for opening and closing. The positive engagement and compact axial components results in short sleeve valves. The tool includes an arm-encircling ring for controlling radial positioning. The encircling ring is situated within the narrow annular space formed between the tool and the sleeve which is at greater risk of interference.

There is interest in the industry for robust apparatus and methods of performing completion operations which are relatively simple, reliable, that could also provide uphole sleeve actuation on demand and which reduce the overall costs involved.

SUMMARY

A bottom hole assembly (BHA), actuator or shifting tool is provided for use in cooperation with one or more downhole tools such as sleeve valves spaced along a tubing string extending downhole such as a completion string or casing.

Downhole tools compatible with a shifting tool include the above sleeve vales, each sleeve valve comprising a sleeve housing spaced along the casing, each sleeve housing fit with a sleeve that is shiftable or axially movable therein to open and close treatment ports formed in the sleeve housing.

Downhole tools that remain downhole are deemed consumables. In other words, the tools are run-in-hole and remain there for the life of the well. Sleeve valves, comprising machined, movable and sealed components are inherently expensive. In particular, there is an interest in minimizing the cost of sleeve valves as consumables. Accordingly, the complexity of the sleeve valve and shifting tool interaction is simplified.

As introduced in Applicant's published Application US20170058644A1, Applicant's prior actuator tool embodies an element or dog that locates and engages intermediate the sleeve for sleeve release, opening and closing. As a result, the corresponding sleeve housing can be short in length, and less expensive to manufacture. Manipulation of the dogs is achieved using up and downhole movement of a shifting mandrel, a cam on the arm supporting the dogs and a cam encircling restraining ring thereabout. As noted earlier, the encircling ring encroaches on the annular space between the tool and the sleeve. The annular space is narrow and can affect tool and fluid movement therethrough. Further, in high force situations, such as in an emergency release, the structure of the ring needs to be robust, the required encircling structure and attachment being correspondingly more robust, further reducing the available annular space.

Herein, the arm, cam and encircling ring structure is replaced with new actuating arrangement. The radial position of the arms and supported dogs are forcibly manipulated using a radially inward yoke or constrictor spider. The spider is secured to the shifting mandrel and is driven uphole and downhole with the mandrel. The axial position of the shifting mandrel can be controlled by a J-Slot mechanism of conventional design. The mandrel is moved axially relative to a tool housing which axially supports the arms and housing a corresponding portion of the J-Slot mechanism, in this embodiment the mandrel supporting the J-Pin and the housing supporting the J-Profile followed by the J-Pin. The tool housing has drag blocks or other movement resisting elements for enabling relative mandrel and tool housing movement and shifting of the J-Slot mechanism. The shifting mandrel is connected to the conveyance tubing and extends though the tool hosing and the tool housing is movable in the tubing string.

The spider has multiple radial spokes, spaced circumferentially about the spider, each spoke extending radially between adjacent arms.

Manipulation of the dogs is achieved using up and downhole movement of the shifting mandrel and constrictor spider secured thereto. The spider comprises two or more radially extending spokes, each spoke having one or two driving tabs that extend circumferentially from the spoke to engage one or two cam surfaces on circumferentially adjacent arm or arms. The cam on the side of each arm varies radially in height and relative to a dog engagement face as the cam extends axially along the arm from a base end to a dog end. The spider's driving tabs remain at a constant radial location and the tab/cam interaction causes the arm to undulate radially as the tab is driven axially therealong. The cam manipulates the dog engagement face radially between a radially outward engagement position and a radially inward position.

As above, axial alignment of the shifting mandrel relative to the cams on the dog arms at least selectively restrains or constrains the dog's radial position for enabling sleeve engagement and disengagement. In the embodiment shown, the J-Slot mechanism, applies four distinct positions to positively engage the dog-receiving sleeve profile for both uphole and downhole operation, yet also be releasable for longitudinal or axial movement to the next sleeve housing.

A new economy and flexibility in treatment methodology is now possible with short sleeve valves, assured sleeve locating, selectable opening and closing of some or all sleeves, and reliable arm manipulation with minimal risk of damage and annular obstruction.

In an embodiment, a cam profile extending along the sides of the actuation arms varies from a shallow cam section to a deep cam section for positioning the arms and shifting the tool between:

- an extreme uphole arm position having a shallow cam section, for releasing the arm radially, the arm biasing the dogs engagement faces radially outward such as for uphole sleeve profile locating and sleeve operation;
- an intermediate downhole arm position having a deep cam section with the dog's engagement face restrained radially inward for uphole and downhole movement; and
- An extreme downhole arm position again having a shallow cam section, for releasing the arm radially, the arm biasing the dogs engagement faces radially outward, which in combination with a cone engagement can lock the arms outwardly for sleeve operation.

In one broad aspect, a shifting tool is provided for a downhole tool located in a tubular string extending downhole, comprising an activation mandrel adapted for conveyance downhole into the tubular string and operating two or more arms for engaging and shifting the downhole tool. A J-Pin is operable with the mandrel relative to a J-Profile within a tool housing, the tool housing movably restrained in the tubular string for axial movement of the mandrel relative to the tool housing. The two or more arms extending axially in an tool annulus formed between the mandrel and the tubular string, the arms spaced circumferentially about the mandrel and each having a base end and an opposing dog end, each arm being radially actuable, to position the dog end between a radially outward engagement position and a radially inward constricted position. Each arm has a cam profile extending along each opposing side of the arm, the mandrel axially movable axially relative to the arms; and a constrictor spider is movable with the mandrel and spokes extending radially from a hub and each spoke between the sides of adjacent arms of the of the two or more arms, each spoke having cam-engaging tabs extending circumferentially to slidably engage a side cam of adjacent arms for at least radial constraint of the arms, the tabs movable axially along the cam with the spider and mandrel to activate the arms between the engagement and constricted positions.

In embodiments the downhole tools are a system of downhole sleeves and actuation thereof by the shifting tool. A completion string has a plurality of sleeve valves therealong, each sleeve valve having a sleeve housing and an axially shiftable sleeve, each sleeve having an annular dog-receiving profile formed intermediate the sleeve. The activation mandrel of the shifting tool is radially actuable between a radially outward biased position, a dog-receiving sleeve profile-engaged position, and a radially inward collapsed position. The shifting tool can shift uphole or downhole to release the sleeve. A cone is movable axially with the mandrel between two positions, an engaged position with the dogs to lock them in the sleeve profile-engaged position and a disengaged position. When locked, a packer seals to the completion string or to the sleeve.

In another embodiment, springs bias each arm radially outwardly from the mandrel; and the constrictor spider is movable axially along the mandrel for actuating the one or more arms between the radially outward and biased position and the radially inward collapsed position.

In another embodiment, each tab of the constrictor ring for the shifting tool comprises both radially spaced outboard and inboard tabs for engaging a radially outward and a radially inward cam surface of each arm respectively. Each arm is being radially actuable between a radially outward position through the inward cam surface and inboard tab, and a radially inward collapsed position through the outward cam surface and outboard tab. Springs can be provided in the spider, arm or dog for providing some radially movement to distinguish between the locating and sleeve engaging positions.

BRIEF DESCRIPTION OF THE DRAWINGS

FIGS. 1A through 3C illustrate the arms and encircling retraining ring of the prior art, in particular;

FIG. 1A is a cross-sectional view of a shifting tool of the prior art, the tool accessing a casing string, the casing string illustrating one sleeve and sleeve housing;

FIGS. 3A, 3B and 3C are views of two opposing arms and restraining ring of a prior art tool illustrating an outside-side view, a cross-sectional view sectioned along line B-B of FIG. 3A and an inside side view of one-half sectioned prior art shifting tool according to FIG. 3B;

DESCRIPTION OF THE PREFERRED EMBODIMENTS

General Overview

In embodiments, tubing conveyed system is provided comprising an actuating or shifting tool that is used to sequentially manipulate a large number of sleeve valves (cemented or uncemented) located in a tubing string extending downhole in an oil or gas well (vertical, deviated or horizontal). The shifting tool engages a sleeve and opens or closes the sleeve in its respective sleeve housing. Each sleeve valve can be manipulated, at any time, and for various reasons without tripping the tool from the wellbore. The shifting tool can be conveyed on a conveyance string of coiled or jointed tubing. Herein the tool is described as being conveyed on coil tubing and hence, a "coil tool".

Herein, the prior art treatment tool, actuating tool and the current shifting tool are all based on an axial arrangement of components that extend generally co-axially with the tubular string. Further, the tool also employs multiple like components distributed about the axis. Those components are referred to as being spaced circumferentially about the axis. For example, where four components are eqi-spaced circumferentially about the axis, they would be spaced at 90 degrees at the 12, 3, 6 and 9 O'clock positions. Further each discrete component has a clockwise side that faces a counterclockwise side of an adjacent circumferentially-spaced component. Further each component therefore has a side and an opposing side. The preceding, and reference to the drawings, is intended to assist with spatial relationship of the axially movable constrictor spider components as it interacts with the tool arms.

Applicant's Prior Art

Figure 1A:
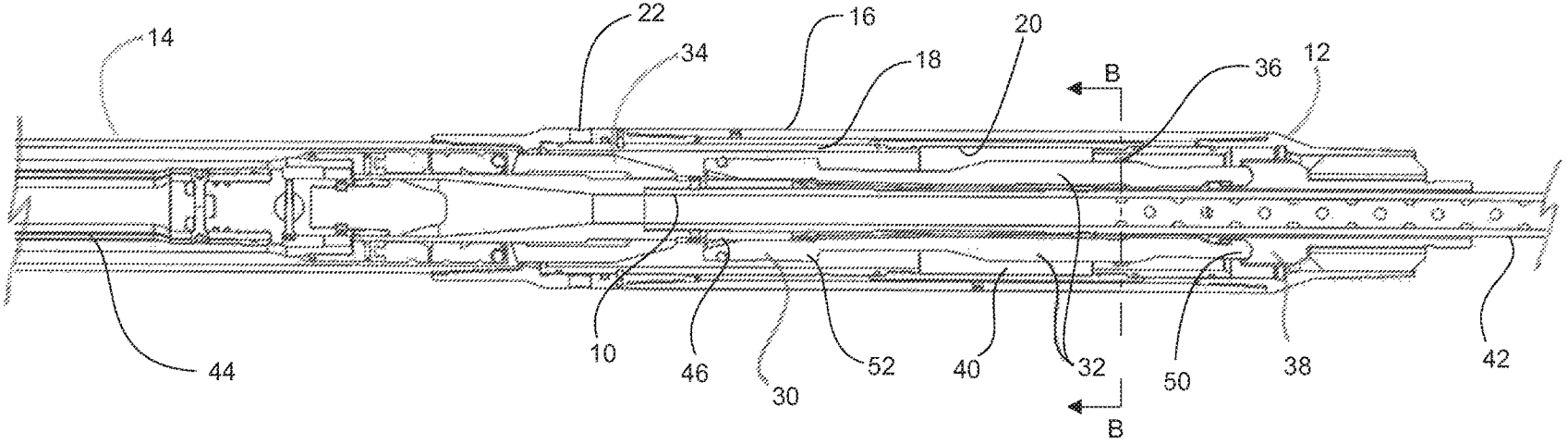
Fig. 1A PRIOR ART
Figure 1B:
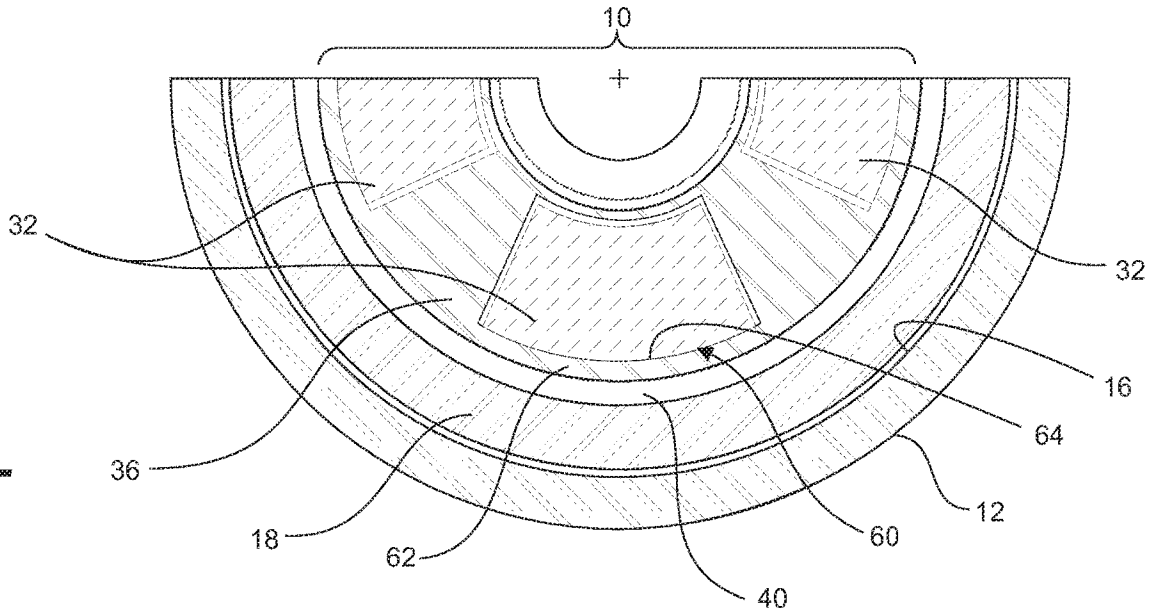
Fig. 1B PRIOR ART
FIG. 1B is a cross-sectional one-half view of the ring and arms of FIG. 1A, sectioned along line B-B.

With reference to FIGS. 1A and 1B, Applicant's prior art treatment tool 10, as described in pending published US20170058644A1, is configured for run-in-hole RIH mode for free movement through sleeve valves 12 and a downhole string such as a completion string 14. The sleeve valve 12 can comprise a tubular sleeve housing 16 fit with a tubular sleeve 18. The sleeve 18 has an annular recess or dog-receiving sleeve profile 20 formed intermediate along its length. As shown in this embodiment of FIG. 1A, the sleeve 18 is shiftable downhole for opening ports 22 uphole of an uphole end of the sleeve. The sleeve profile is intermediate the sleeve's length. The profile 20 is annular can has a generally right angle uphole interface for positive sleeve profile locating purposes.

Figure 2A:
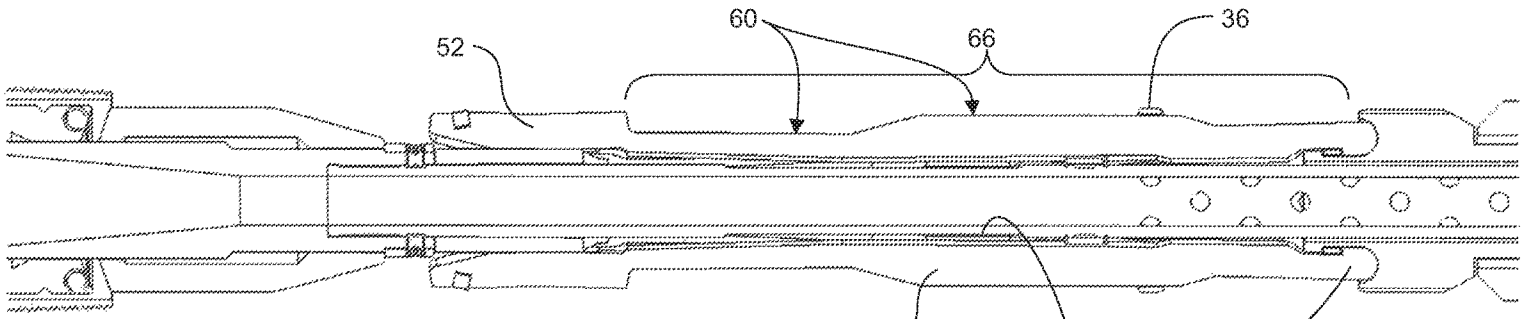
Fig. 2A PRIOR ART
FIGS. 2A, 2B and 2C illustrate embodiment of the tool's arms according to FIG. 1A, showing the arm orientation related to operations uphole sleeve locating and closing operations, releasing the tool for running in hole or tool repositioning, and forcibly engaging the downhole tool respectively.
Figure 3B:
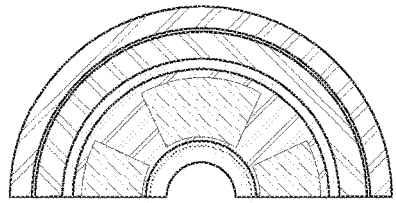
Fig. 3B PRIOR ART
Figure 3A:
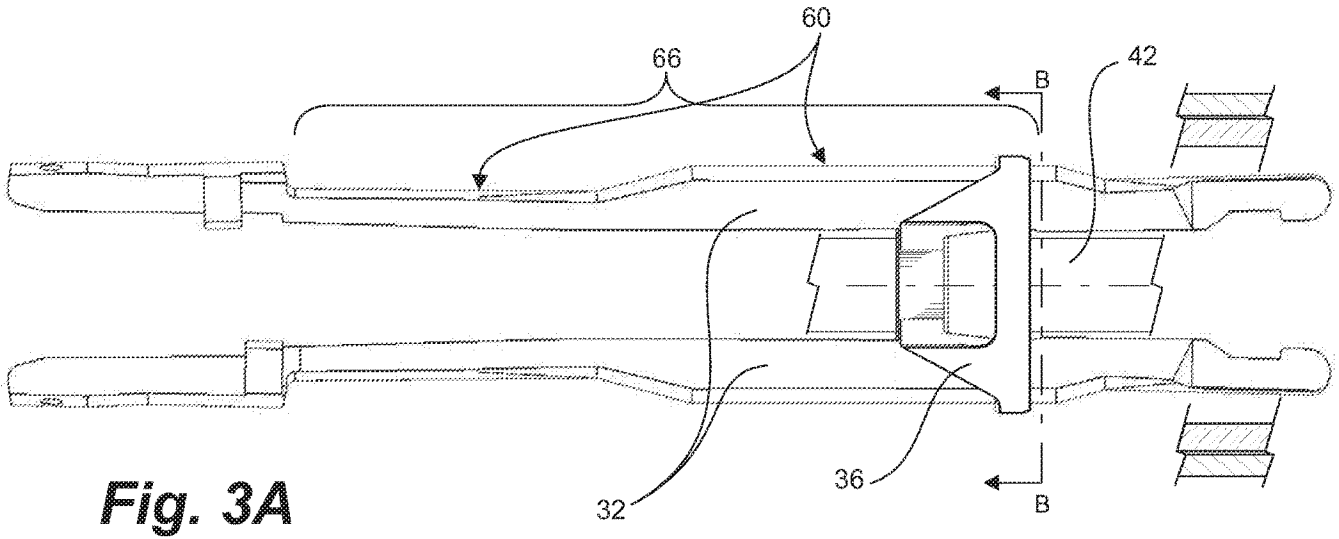
Fig. 3A PRIOR ART
Figure 3C:
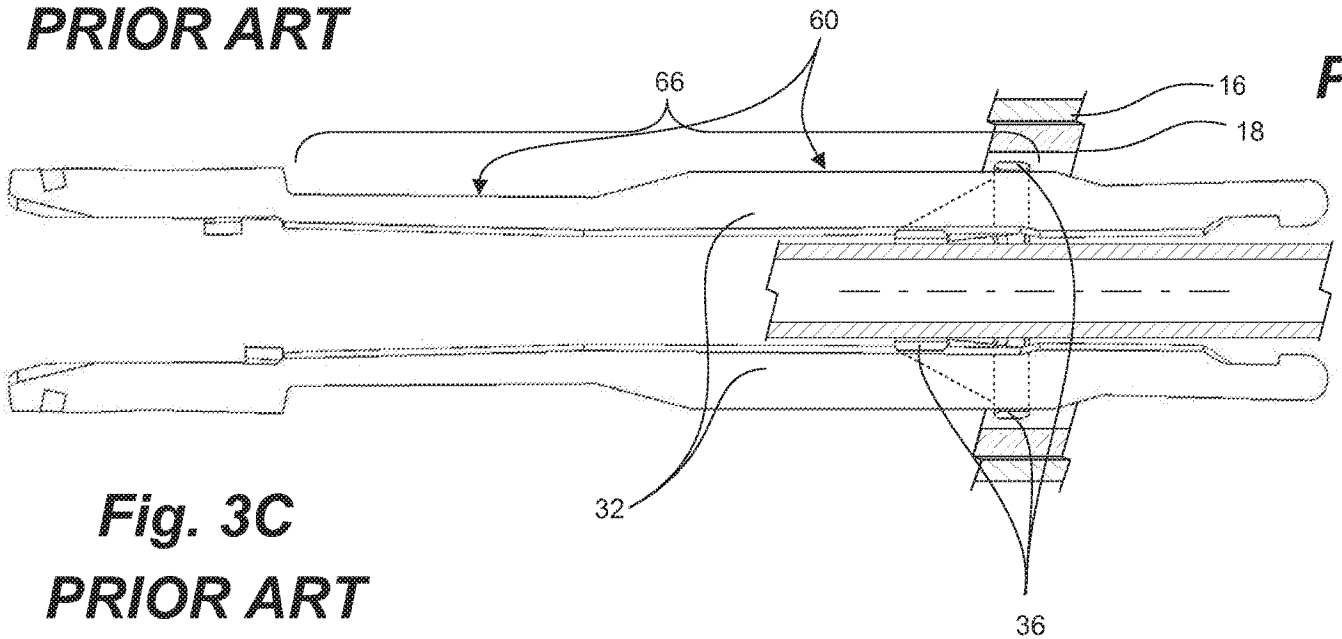
Fig. 3C PRIOR ART

With reference to FIGS. 1A and 2A, Applicant's prior shifting tool employs dogs 30 for engaging the sleeve profile 20. The dogs 30 are located at ends of radially controllable, and circumferentially spaced support arms 32 are actuated radially inward to overcome biasing for either into and out-of-hole movement, and for releasing the arms 32 for sleeve locating and sleeve profile engagement. The dogs 30 can be positively locked in the sleeve profile 20 for opening and closing with a locking wedge cone 34. The tool includes an arm-encircling restraining ring 36 for controlling radial positioning. As shown in FIGS. 1B and 3C, the encircling ring 36 is situate within the narrow tool annulus 40 formed between the shifting tool 10 and the sleeve 18 which is at greater risk of interference with irregularities in the bore of the downhole string. The arm's dog 30 also has generally right angle uphole and downhole interfaces. The shifting tool 10 is manipulated to be restrained radially inwardly for RIH and POOH operations. The tool's dog 30 and sleeve profile 20 component eliminates the need for an independent location device such as a collar or sleeve end locator. An uphole shoulder of the dog is used to locate an upper shoulder of the sleeve profile for location purposes and for optional release, shifting uphole for re-closing or both. There is no need to compromise dog-locator function by requiring structure to distinguish between the profile, sleeve ends or casing collars as is performed in conventional tools.

Further, the prior shifting tool further comprises an axially-manipulated activation mandrel 42 extending slidably through bore of the shifting tool conveyed downhole on a conveyance string 44. The mandrel 42 is connected downhole to an axially indexing J-slot mechanism and drag block. The actuation portion of the tool comprises the radially actuable arms supporting the profile-engaging dogs, radial arm biasing springs 46, an axially movable retaining ring for arm mode shifting and a dog locking cone. The mandrel is connected to the conveyance string for axial manipulation therewith. The mandrel can be tubular for selectable fluid communication therethrough: blocked, when performing treatment operations; and open, when moving the tool. The radially actuable arms comprise three or more circumferentially spaced, and generally axially-extending arms 32 bearing dogs 30 at one end thereof.

In Applicant's prior tool, each arm 32 has an upstanding or radial extent that varies along its axial length, forming a cam 60 having a cam profile 66 on the radially outer most surface. The restraining ring 36 has an annular ring portion 62, forming an arm annulus 64 through which the arms pass axially. For shifting mode of the dog 30 and sleeve engagement, the annular ring 62 is moved axially along the arms 32 and thus along the arm cam 60, driven by the axial indexing of the mandrel 42. Indexed axially, the annular ring 62 alternately engages either radially upstanding portion or radially depressed portion of the arm's cam 60 to forcibly drive the arms 32 radially inward or release the arms to move radially outward respectively. When the restraining ring 36 radially releases the arms, springs 46 bias the arms outwardly for a mode including to enable the dogs to resiliently drag along the downhole string 14 and inner diameter of the sleeve valve bores such as to axially locate the sleeve profile 20.

As set forth above, the restraining ring occupies an unfortunate cross section of the tool annulus. As shown in FIGS. 1B, 3B and 3C when the arm is in the mode with the restraining ring at the radially upstanding portion, the tool annulus is nearly obscured.

Current Embodiment

Herein, like elements bear the same reference numbers as used for the Applicant's prior art tool. Turning to the improved shifting tool of the current embodiments, the restraining ring 36 and arms 32 of Applicant's prior tool have been replaced so as to occupy less of the tool annulus 40 and provide a robust, damage resistant actuator.

Turning to the embodiments of FIGS. 4A through 5C, the activation mandrel 42 is adapted for conveyance on a conveyance string 44, such as coiled tubing, downhole into the tubular downhole string 14. Two or more circumferentially-spaced, and generally axially-extending arms 32 are circumferentially spaced about the activation mandrel 42. Four arms 100 are illustrated at four quadrants about the mandrel 42. Each arm 100 is pivoted at a ball and socket or base end 50 connected at the arm retainer 38 adjacent at one end (herein the downhole end), with the dogs 30 located at the other opposing dog end 52 (the uphole end).

While not illustrated herein, but described fully in Applicant's published pending published application US20170058644A1, a J-slot mechanism 92 is connected to the arm retainer 38 for controlled manipulation of the mandrel 42 relative to the retainer 38 and arms 100 supported thereby. The J-slot mechanism 92 can be conventional mechanical design having a J-Pin 154 operable with the mandrel relative to a pin-receiving J-Profile within a tool housing, the tool housing movably restrained in the tubular string, such as with a casing collar locator or a drag block, for aiding in axial movement of the mandrel relative to the tool housing. The drag block can include re-tasking a casing collar locator as a drag block, or a stacked beam drag block as introduced by Applicant in published application US20160245029A1 published Aug. 25, 2016, incorporated herein by reference in its entirety. J-Slot sequencing may be set up in a scenario of patterns selected at surface before running in hole by substitution of the J-Slot sleeve profile.

Each arm 100 is radially actuable, to position the dog end 52 between a radially outward engagement position and a radially inward constricted position.

Figure 4A:
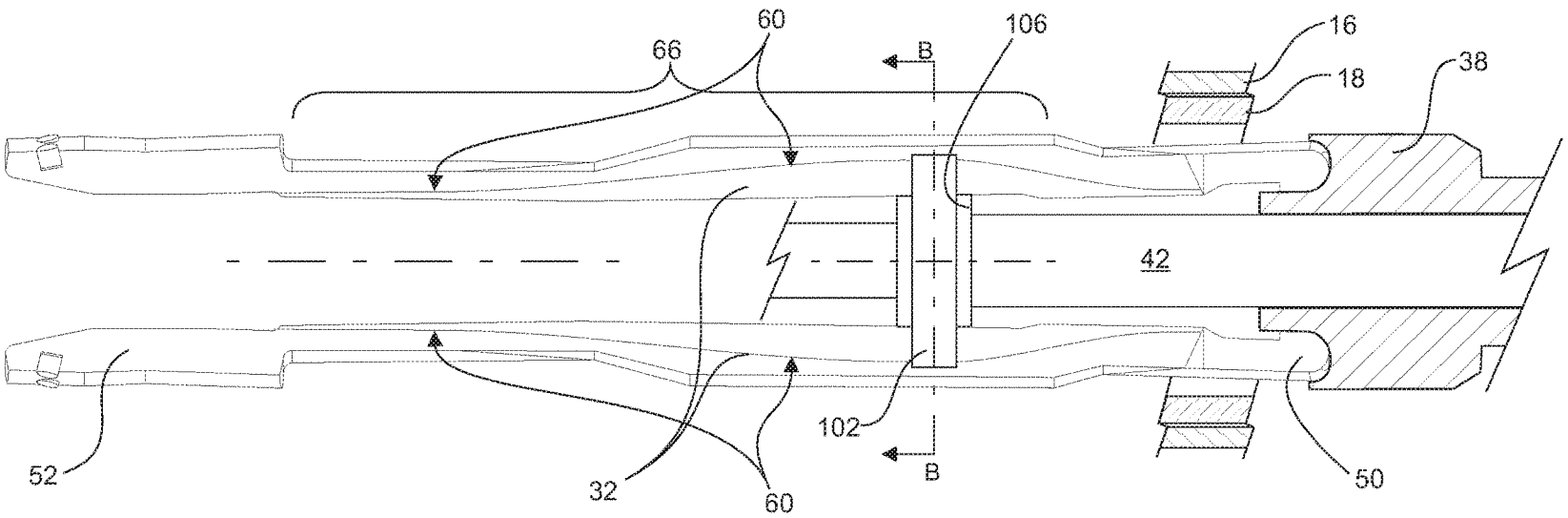
FIG. 4A is an outside-side view of two opposing arms embodying a constrictor spider according to one current embodiment, the arms manipulated to a radially inward position suitable for running in, repositioning and pulling out.

In contradistinction to the prior art, the arm 100 is manipulated radially using a constrictor spider 102 which is axially fixed to the mandrel 42 and driven uphole and downhole relative to the arms by 100,100 . . . the conveyance string 44 and corresponding movement of the mandrel 42. The spider 102 can be affixed to the mandrel 42 with straddling snap rings as shown in prior art FIGS. 2A-2C or in instances where significant axial forces are applied, as shown in FIG. 4A, an upset or shoulder 106 can be formed on the mandrel 42 to axially back or support the spider 102.

Figure 4B:
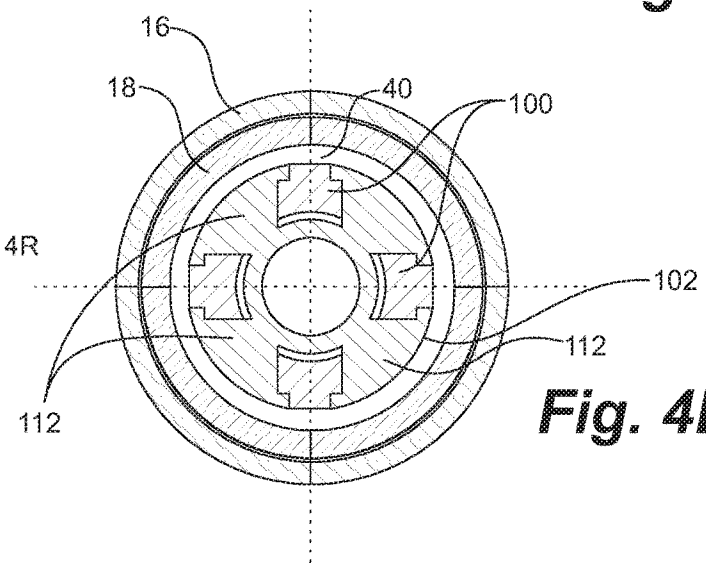
FIG. 4B is a cross-sectional view of the constrictor spider and arms of FIG. 4A, sectioned along line B-B.

With reference to FIG. 4B, the spider 102 comprises a hub 110 secured to the mandrel 42 and two or more spokes 112 extending radially therefrom. Each spoke 112 extends between sides 114L,114R of adjacent arms 100,100; four circumferentially spaced spokes 112 corresponding to four arms 100.

Each spoke 112 has at least opposing cam-engaging first tabs 120, each tab 120L,120R extending circumferentially from opposing sides respectively of the spoke 112. Each arm 100 has cams 60R,60L extending circumferentially from the opposing sides 114R,114L of the arm. Each cam 60 has a cam profile having at least a radially-outward facing cam surface 66. The cam has a radial height that varies along at least a portion of the arm's axial length. The spider 102 and tabs 120 have a fixed radial dimension. Accordingly as the spider and tabs move axially uphole and downhole, the tabs remain at a constant radial extent.

The first tabs 120L,120R are located radially outward of the cams and extending circumferentially to encircle the arm and engage respective cams 60R,60L for radially inward control or radial restraint of the cams and associated arm. As tabs 120 move axially along the arm 100 with the spider 102 and mandrel 42, the tabs 120 engage at least the respective cam's upper cam surfaces 66 to activate the arms 100 between the engagement and constricted positions.

As shown, in the embodiment in which the arm's dog ends 52 are oriented uphole and the base end 50 oriented downhole, the J-Pin 154 is shiftable within the tool housing's J-Profile to locate the mandrel 42 and spider's tabs 120 along the arm's cam profile 66 to at least a downhole and an uphole position.

Figure 4C:
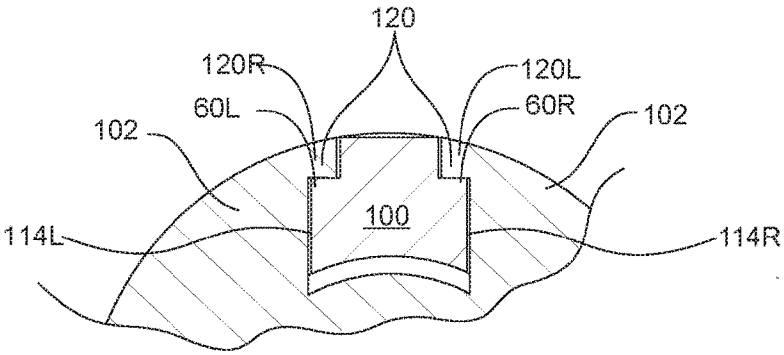
FIG. 4C is a close up cross-sectional view of one arm and opposing constrictor spider tabs for the arm of FIG. 4B.

As shown in FIGS. 4A, 4B and 4C, in one position along the cam's profile 60, the cam 60 is a deep cam in which the cam's upper surface extends closer to a radially outward extent of the arm. Accordingly, and conversely, the tab 120, being radially invariate, forces the cam-bearing arm 100 radially inward.

Figure 5A:
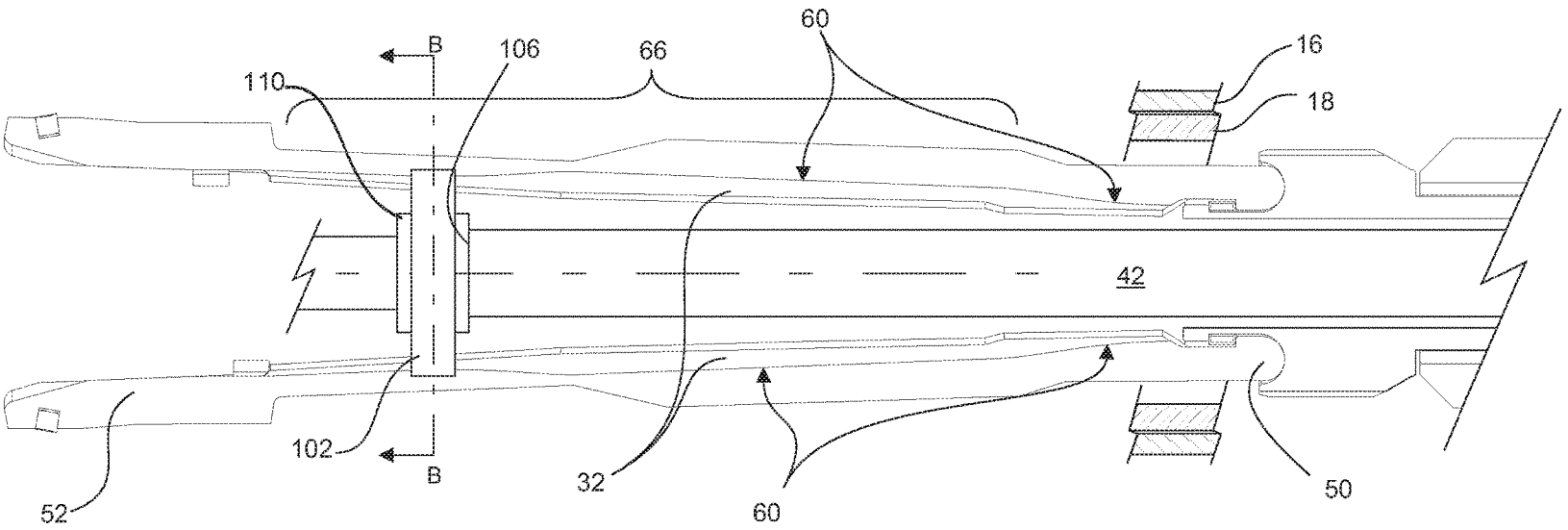
FIG. 5A is an outside-side view of the two opposing arms of FIG. 4A with the arms manipulated to a radially outward position suitable for locating and setting.
Figure 5B:
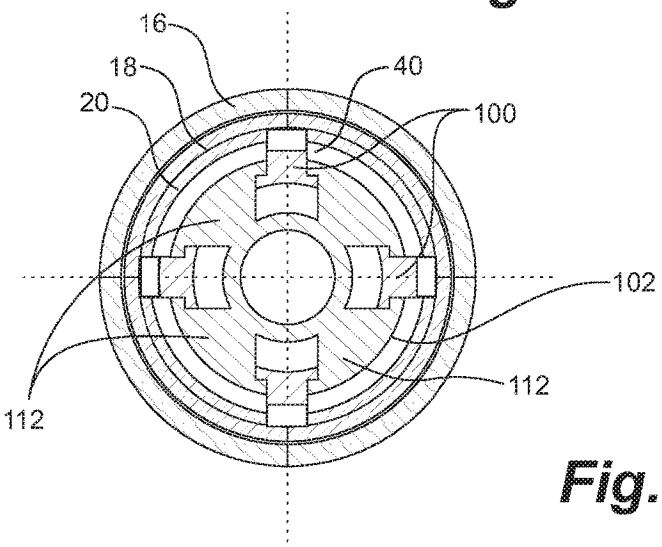
FIG. 5B is a cross-sectional one-half view of the constrictor spider and arms of FIG. 5A, sectioned along line B-B.
Figure 5C:
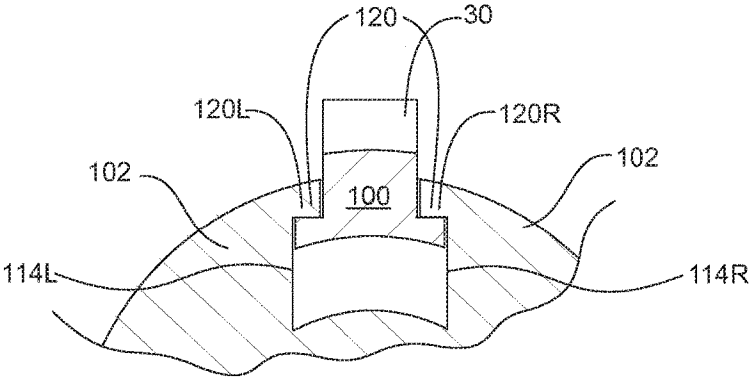
FIG. 5C is a close up cross-sectional view of one arm and opposing constrictor spider tabs for the arm of FIG. 5B.

As shown in FIGS. 5A, 5B and 5C, in a second position along the cam's profile 66 along the arm 100, the cam 60 has a shallow cam in which the cam's upper surface extends closer to a radially inward extent of the arm 100. Accordingly, the tab permits the cam-bearing arm 100 to move radially outward releasing the arms and respective dogs to the radially outward position to engage the downhole tool. When released radially outward, springs 46 bias the arms 100 outwardly to resiliently drag along the downhole string 14 and bore of the sleeve valves such as to axially locate the sleeve profile 20 with the dogs 30. When the sleeve 18 is located, further axial shifting of the activation mandrel axially engages a locking cone 30 radially under the dog end 52, forcibly driving the dogs 30 outward and locking them into the sleeve profile 20 for positive manipulation of the sleeve 18.

Each spoke 112 has generally radially-extending side walls that correspond to the side walls 114L,114R of adjacent arms 100, providing circumferential support for the arms. As the tabs 120 must remain in engagement at various radial positions along the arm 100 and cam 60, and to avoid customizing arm width for cam depth, the arms are formed with parallel, square sides 114L,114R, those square sides being parallel to a radial extending through a centerline of the respective arm. The square sides enable movement of the arm radially between the opposing tabs.

The side walls or structure of the spokes, radially inward of the tabs, is not so constrained. Practically, a robust spoke has corresponding generally radially-extending sides. Where the side walls are parallel, the cross-section of each arm is generally rectangular and the cross-section of each spoke is trapezoidal.

To minimize obstruction of the toll annulus, the radial extent of the constrictor tabs does not extend radially outside a radial extent of the arms.

With reference to FIG. 4A, the spider 102 can be secured to the mandrel 42 for supporting extreme axial forces including pulling a set dog 30 uphole out of the sleeve's recess profile 20. As set forth above, the mandrel 42 can be fit with a downhole upset 106. The hub 110 of the spider 102 can be installed onto the mandrel to stop against this upset 106. Further to ensure the hub is secured uphole and downhole, one or more of the spokes 112 can be fit with a radial bore for receiving a fastener such as a cap screw therein for fixing the constrictor spider 102 to the mandrel 42.

Figure 2B:
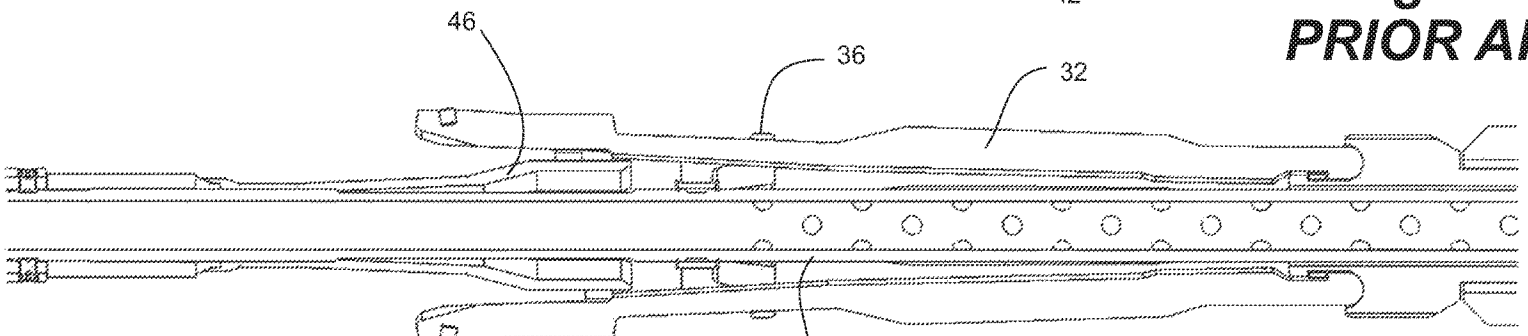
Fig. 2B PRIOR ART
Figure 2C:
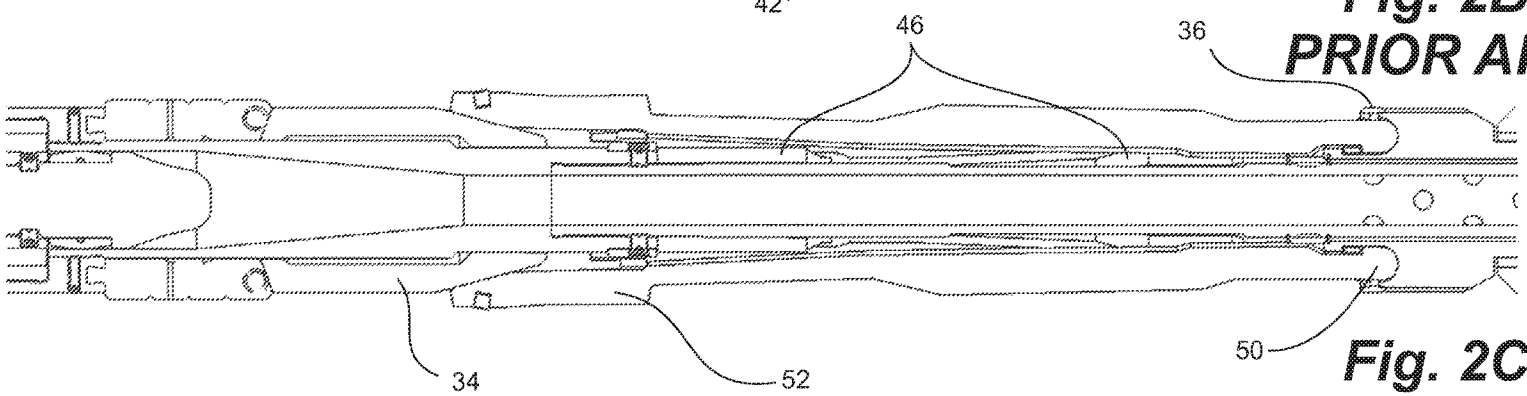
Fig. 2C PRIOR ART

The arms 100 can be biased by springs 46, as used in Applicant's prior tool as shown in FIG. 2B.

In yet another embodiment, the cams 60 on the arms are double sided, having the first outward facing surface 66 and a second inward facing surface for driving the arm radially inward and radially outward respectively. As the arm 100 can be used for locating with some radial forgiveness. The outward driving cam or the dog 30 can be spring loaded for locating purposes. Alternatively, a less capable biasing that used in Applicant prior tool can be applied between the arm and the spider, or mandrel as the radial positioning is aided by the second tab.

Figure 3D:
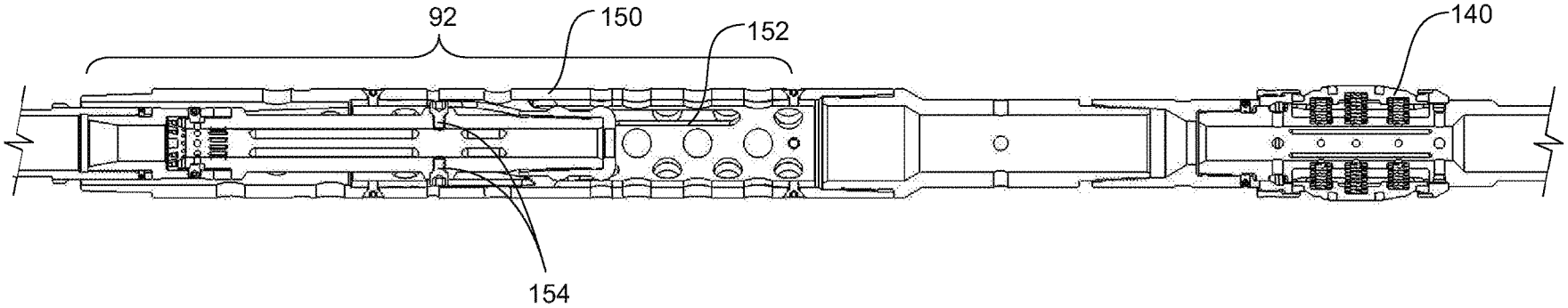
FIG. 3D is a cross-section view of a downhole end of an actuator tool including a J-slot mechanism and a drag block, the J-Slot mechanism having a portion of the structure housing removed to better illustrate the configurable J-Profile and opposing a J-Pin shifting mandrel.

With refernece to FIG. 3D, the tool includes the J-Slot mechanism 92 for indexing the activation mandrel 42 and the J-Slot mechanism 92 having the J-Pin 154 operable in the J-Slot housing 150 and a drag sub 140 to restrain the J-slot housing during cycling. As also was the case for Applicant's prior tool, a J-Slot Profile 152 includes at least four axial positions. Of the four axial positions two are extreme positions: one extreme position that drives a cone into engagement with the dogs to locking the dogs to a located sleeve profile; and the one second extreme position that first frees the dogs for locating along the inside wall of the completion string for locating the sleeve profile. The remaining modes are intermediate axial positions, both of which restrain the dogs' radial position to enable free movement up and down the conveyance string.

We claim:

1. A shifting tool for a downhole tool located in a tubular string extending downhole, comprising:

an activation mandrel adapted for conveyance downhole into the tubular string;

two or more arms, extending axially in an annulus formed between the activation mandrel and the tubular string, the arms spaced circumferentially about the mandrel and each arm having a base end and a dog at an opposing dog end, each arm being radially actuable, to position the dog end between a radially outward engagement position and a radially inward constricted position, and having a cam profile extending along each opposing side of the arm, the mandrel axially movable axially relative to the arms; and a constrictor spider secured to the mandrel, the spider having one or more spokes extending radially from a hub and each spoke between the sides of adjacent arms of the two or more arms, each spoke having cam-engaging tabs extending circumferentially to slidably engage a side cam of adjacent arms for at least radial constraint of the arms, the tabs movable axially along the cam with the spider and mandrel to activate the arms between the engagement and constricted positions.

2. The shifting tool of claim 1 wherein the mandrel is sequenced between the radially outward engagement position and the radially inward constricted position using a J-Pin operable with the mandrel relative to a J-Profile within a tool housing, the tool housing movably restrained in the tubular string for axial movement of the mandrel relative to the tool housing.

3. The shifting tool of claim 2 wherein the arm's dog end is oriented uphole and the base end oriented downhole, the J-Pin is shiftable within the J-Profile to locate the mandrel and tabs along the arm's cam profile at, at least:

a first intermediate downhole position wherein the constrictor tabs engage a deep cam profile to constrain the arms and respective dogs in the radially inward constrained position; and a first extreme uphole position wherein the constrictor tabs engage a shallow cam profile to release the arms and respective dogs to a radially outward biased position to engage the downhole tool.

4. The shifting tool of claim 3 wherein the downhole tool is a sleeve valve having a shiftable sleeve, the sleeve having a dog-receiving profile, and wherein in the J-Profile's first extreme uphole position, the radially outward biased dogs are passively movable radially into and out of the dog-receiving profile.

5. The shifting tool of claim 3 wherein the mandrel is fit with an uphole cone movable therewith, and the J-Pin is further shiftable in the J-Profile to locate the mandrel and constrictor tabs along the arm's cam profile at an extreme downhole position wherein an uphole cone on the mandrel engages the dogs and the constrictor tabs engage a shallow cam profile to release the arms and respective dogs, the cone driving the dogs radially outwardly to lock into the downhole tool.

6. The shifting tool of claim 1 wherein the downhole tool is a sleeve valve having a shiftable sleeve.

7. The shifting tool of claim 6 wherein the dogs engage a dog-receiving sleeve profile in the sleeve.

8. The shifting tool of claim 1 wherein the mandrel has an upset forming an annular stop downhole of the constrictor spider.

9. The shifting tool of claim 1 wherein one or more of the one or more spokes is fit with a radial bore for receiving a fastener therein for fixing the constrictor to the mandrel.

10. The shifting tool of claim 1 wherein each spoke has generally radially-extending side walls that correspond to the side walls of adjacent arms, providing circumferential support for the arms.

11. The shifting tool of claim 10 wherein each arm has generally radially extending side walls and the spoke has corresponding generally radially-extending sides.

12. The shifting tool of claim 11 wherein the cross-section of each arm is rectangular and the cross-section of each spoke is trapezoidal.

13. The shifting tool of claim 1 wherein a radial extent of the constrictor tabs remains within a radial extent of the arms.

14. The shifting tool of claim 1 wherein a radial extent of the constrictor tabs does not extend radially into the tool annulus.

15. A shifting tool for sleeve valves in a downhole string comprising:

an activation mandrel connected to a J-Slot mechanism having a J-Pin operable in a J-Profile of a tool housing and a drag block for restraining the tool housing in the downhole string;

one or more dogs supported on a dog end of each of the two or more pivotable arms, the arms and dogs supported about and movable axially along the mandrel, each dog being radially actuable between a radially outward biased position, a sleeve profile-engaged position, and a radially inward collapsed position, each arm having a cam having a radially variable profile thereal-long; and a constrictor spider secured to the mandrel, the spider having at least outboard tabs for engaging the arm cam for actuating the one or more arms between the radially outward biased position and the radially inward collapsed position.

16. The shifting tool of claim 15 wherein the mandrel is connected to a downhole end of a conveyance string extending downhole into the downhole string.

17. The shifting tool of claim 15 comprising springs for biasing each dog radially outwardly from the activation mandrel.

18. The shifting tool of claim 17 wherein the springs bias each arm radially outwardly from the activation mandrel.

19. The shifting tool of claim 15 wherein the activation mandrel further comprises an engagement locking cone axially movable therewith, the cone being uphole of the constrictor spider, and the radially variable profile of the arms' cams cooperate with a sequence of the J-slot mechanism for axially positioning the constrictor spider at:

a first intermediate downhole position to shift the dogs to the radially inward collapsed position without engaging the locking cone with the dogs, a first extreme uphole position to shift the dogs to the radially outward biased position and profile engaging position when so located;

an extreme downhole position to open the sleeve and move the locking cone to the engaged position for treatment;

an intermediate uphole position to shift the dogs to the radially inward collapsed position for pulling out of hole; and a return to the first intermediate downhole position to restart the sequence.

* * * * *